US011690455B2

(12) United States Patent
Smith et al.

(10) Patent No.: US 11,690,455 B2
(45) Date of Patent: Jul. 4, 2023

(54) SYNCHRONOUS-TILT RECLINING CHAIR

(71) Applicant: Dinkar Chellaram, Bangalore (IN)

(72) Inventors: Shaun Smith, Harleysville, PA (US); John Chierici, Philadelphia, PA (US); Jeff Theesfeld, Schwenksville, PA (US)

(73) Assignee: Dinkar Chellaram, Bangalore (IN)

( * ) Notice: Subject to any disclaimer, the term of this patent is extended or adjusted under 35 U.S.C. 154(b) by 0 days.

(21) Appl. No.: 17/478,897

(22) Filed: Sep. 18, 2021

(65) Prior Publication Data

US 2022/0087425 A1 Mar. 24, 2022

Related U.S. Application Data

(60) Provisional application No. 63/080,364, filed on Sep. 18, 2020.

(51) Int. Cl.
*A47C 1/031* (2006.01)
*A47C 1/032* (2006.01)

(52) U.S. Cl.
CPC ..... *A47C 1/03261* (2013.01); *A47C 1/03272* (2013.01); *A47C 1/031* (2013.01); *A47C 1/032* (2013.01)

(58) Field of Classification Search
CPC ..... A47C 1/03261; A47C 1/03272
USPC ..... 297/300.2, 300.5, 316, 340, 341, 342
See application file for complete search history.

(56) References Cited

U.S. PATENT DOCUMENTS 4,270,797 A * 6/1981 Brauning ..... A47C 1/03283 297/316
4,653,806 A * 3/1987 Willi ..... A47C 1/03266 297/300.5 X
4,685,730 A * 8/1987 Linguanotto ..... A47C 1/03255 297/316
4,709,963 A * 12/1987 Uecker ..... A47C 1/03266 297/316
4,840,426 A * 6/1989 Vogtherr ..... A47C 1/03255 297/300.5 X
4,848,837 A * 7/1989 Volkle ..... A47C 1/0325 297/316
4,877,291 A * 10/1989 Taylor ..... A47C 1/03283 297/300.3 X (Continued)

FOREIGN PATENT DOCUMENTS

CN 103479112 A * 1/2014 ..... A47C 1/03255
CN 103504845 A * 1/2014 ..... A47C 1/03255

(Continued)

*Primary Examiner* — Rodney B White
(74) *Attorney, Agent, or Firm* — Howson & Howson LLP

(57) ABSTRACT

A synchronous-tilt reclining office chair includes a seat, a backrest interconnected to the seat, and an arrangement providing a synchronous-tilt mechanism that controls synchronous movement of the backrest and seat between a normal non-reclined position and a reclined position. Recline tension provided by the arrangement is a function of a force required to compress at least one tensioning spring mounted below the seat, a weight applied on the seat by a seat occupant, and a location of the weight on the seat relative to front and rear portions of the seat, whereby, as the weight is applied toward the front portion of the seat, recline tension is reduced and, as the weight is applied toward the rear portion of the seat, recline tension is increased.

14 Claims, 12 Drawing Sheets

(56) References Cited

U.S. PATENT DOCUMENTS 4,966,411 A * 10/1990 Katagiri ..... A47C 31/126 297/300.5 X
5,026,117 A * 6/1991 Faiks ..... A47C 7/441 297/300.5 X
5,106,157 A * 4/1992 Nagelkirk ..... A47C 1/03255 297/300.5 X
5,160,184 A * 11/1992 Faiks ..... A47C 3/026 297/300.5 X
5,251,958 A * 10/1993 Roericht ..... A47C 31/126 297/321
5,354,120 A * 10/1994 Volkle ..... A47C 1/03255 297/342 X
5,366,274 A * 11/1994 Roericht ..... A47C 1/03255 297/300.2 X
5,486,035 A * 1/1996 Koepke ..... A47C 1/03255 297/340
5,582,459 A 12/1996 Hama et al.
5,601,336 A * 2/1997 Troyas-Bermejo ..... A47C 1/03272 297/316
5,660,439 A * 8/1997 Unwalla ..... A47C 1/03255 297/300.5 X
6,027,169 A * 2/2000 Roslund, Jr. ..... A47C 1/03261 297/341 X
6,109,694 A * 8/2000 Kurtz ..... A47C 1/03255 297/300.2 X
6,394,549 B1 * 5/2002 DeKraker ..... A47C 7/24 297/342 X
6,609,755 B2 * 8/2003 Koepke ..... A47C 7/282 297/300.2 X
6,685,267 B1 * 2/2004 Johnson ..... A47C 1/03238 297/316
6,709,058 B1 * 3/2004 Diffrient ..... A47C 31/126 297/316
6,886,888 B2 5/2005 Bock
6,890,030 B2 * 5/2005 Wilkerson ..... A47C 1/023 297/316
6,923,503 B2 * 8/2005 Sangiorgio ..... A47C 1/03255 297/342 X
7,114,777 B2 10/2006 Knoblock et al.
7,467,826 B1 * 12/2008 Wen ..... A47C 1/03294 297/300.8 X
7,497,515 B2 * 3/2009 Krehm ..... A47C 7/443 297/300.5 X
7,530,637 B1 * 5/2009 Wu ..... A47C 1/03266 297/300.5 X
7,717,515 B2 * 5/2010 Saez ..... A47C 1/032 297/316
7,798,573 B2 9/2010 Pennington et al.
7,837,265 B2 11/2010 Machael et al.
7,992,937 B2 * 8/2011 Plikat ..... A47C 31/126 297/316
8,272,692 B1 * 9/2012 Epperson ..... A47C 1/03283 297/300.2 X
8,899,681 B2 * 12/2014 Ko ..... A47C 1/03294 297/340 X
8,944,507 B2 2/2015 Goetz
9,414,684 B2 8/2016 Park et al.
9,521,907 B2 12/2016 Romero
9,585,479 B2 3/2017 Keilhauer et al.
9,801,471 B2 10/2017 Machael et al.
9,974,389 B2 5/2018 Sander et al.
10,362,874 B2 7/2019 Walker et al.
10,383,445 B2 8/2019 Serber
10,433,642 B2 10/2019 Schneider
10,610,019 B2 4/2020 Bock
2003/0184140 A1 * 10/2003 Bruske ..... A47C 1/03255 297/316
2005/0275265 A1 * 12/2005 Deimen ..... A47C 1/03255 297/316
2008/0272638 A1 * 11/2008 Bock ..... A47C 1/03272 297/316
2011/0074197 A1 * 3/2011 Okamoto ..... A47C 1/03272 297/300.6 X
2011/0304192 A1 12/2011 Augustat
2012/0025574 A1 * 2/2012 Wilkinson ..... A47C 7/14 297/316 X
2015/0102648 A1 * 4/2015 Park ..... A47C 1/03277 297/340
2015/0245713 A1 * 9/2015 Desanta ..... A47C 7/44 297/316
2015/0342353 A1 * 12/2015 Keilhauer ..... A47C 1/03255 297/316
2020/0085194 A1 * 3/2020 Maier ..... A47C 1/03261

FOREIGN PATENT DOCUMENTS

CN 104223821 A * 12/2014 ..... A47C 1/03255
CN 204181246 U * 3/2015 ..... A47C 1/03255
CN 111387745 A * 7/2020 ..... A47C 1/03238
EP 2926690 A1 * 10/2015 ..... A47C 1/03211
EP 3649893 A1 * 5/2020 ..... A47C 1/03272
WO WO-2008020824 A2 * 2/2008 ..... A47C 1/03255

* cited by examiner

SYNCHRONOUS-TILT RECLINING CHAIR

CROSS REFERENCE TO RELATED APPLICATIONS

This application claims the benefit under 35 USC § 119(e) of U.S. Provisional Patent Application No. 63/080,364 filed Sep. 18, 2020.

BACKGROUND

The present invention relates to chairs, such as task and side office chairs, and more particularly, to an office chair that can be reclined.

Office chairs are known to include a seat, a reclinable backrest, and a mechanism that enables synchronous movement of the seat with the backrest as the backrest is reclined from a generally upright position or returned to the upright position from a reclined position. Recline tension provided by the chair may be automatically set as a function of a weight applied to the chair by the occupant seated in the chair. Thus, when a person is sitting with good posture, and at their healthiest position for maximum core strength, the recline tension is set in balance with the occupant's weight. This automatic weight-sensing feature eliminates the need to manually adjust tension each time a different user sits in the chair. Accordingly, the chair may be automatically tensioned correctly for each occupant.

An occupant of a chair may assume a sitting position with a relatively poor posture (i.e., may be slid forward in the seat in a relatively slouched position). This is generally considered an unhealthy sitting position. A problem in particular with a slouched seating position in a reclinable chair that automatically adjusts recline tension based on occupant weight is that the automatically adjusted recline tension necessarily applies a relatively high amount of pressure on the lower back when the occupant attempts to recline the chair. This provides risk for injury.

The above referenced weight sensing chairs typically use some form of a parallelogram, or four-bar linkage, to raise and lower the seat. Thus, as the backrest is caused to be moved to a reclined position, the front and rear of the seat may be caused to move upward. However, this results in a further problem in that lifting of the front of the seat may impinge upon the underside of the occupant's knee and restrict blood flow to the legs of the occupant to some extent.

Accordingly, a self-tensioning reclinable office chair that addresses at least some of the above referenced problems is desired.

SUMMARY

According to an embodiment, a chair is provided having a seat base, a backrest interconnected to the seat base via a hinge connection and movable relative to the seat base about a backrest pivot axis between a normal non-reclined position and a reclined position, and a seat supported on the seat base and having a rear portion adjacent the backrest and a front portion defining a front edge of the seat. The rear portion of the seat is interconnected to the backrest via a hinge connection such that as the backrest is pivoted to the reclined position, the rear portion of the seat pivots relative to the backrest of the seat and is elevated. The front portion of the seat is interconnected to the seat base via a hinge connection such that the seat is movable about a seat front pivot axis and such that as the backrest is pivoted to the reclined position and the rear portion of the seat is elevated, the seat pivots about the seat front pivot axis thereby causing the front edge of the front portion of the seat to be lowered.

The chair may include a tensioning spring, a plunger for engaging the tensioning spring, and a front support bar that interconnects to the plunger and defines the seat front axis pivot axis about which the seat pivots. The tensioning spring may be mounted on the seat base beneath the seat such that a rear end of the tensioning spring is mounted to the seat base in a stationary position relative to the seat base. The front support bar extends within at least one slot formed by the seat base such that, as the backrest is pivoted to the reclined position, the rear portion of the seat is elevated, and the front portion of the seat is lowered, the front support bar moves to a rearward location within the at least one slot causing the plunger to compress the at least one tensioning spring.

According to an embodiment, recline tension provided by the chair is a function of a force required to compress the at least one tensioning spring mounted below the seat, a weight applied to the seat by a seat occupant, and a location of the weight applied to the seat relative to front and rear portions of the seat. Accordingly, as the weight is applied toward the front portion of the seat (such as by an occupant in a slouched seated position), the recline tension is reduced and, as the weight is applied toward the rear portion of the seat (such as by an occupant seated in an upright position with good posture), recline tension is increased.

BRIEF DESCRIPTION OF THE DRAWINGS

The foregoing and other objects, features and advantages of the embodiments disclosed herein should become apparent from the following description when taken in conjunction with the accompanying drawings.

DETAILED DESCRIPTION

For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to these specific details. In some instances, well known methods and structures have not been described in detail so as not to unnecessarily obscure the embodiments.

Figure 1:
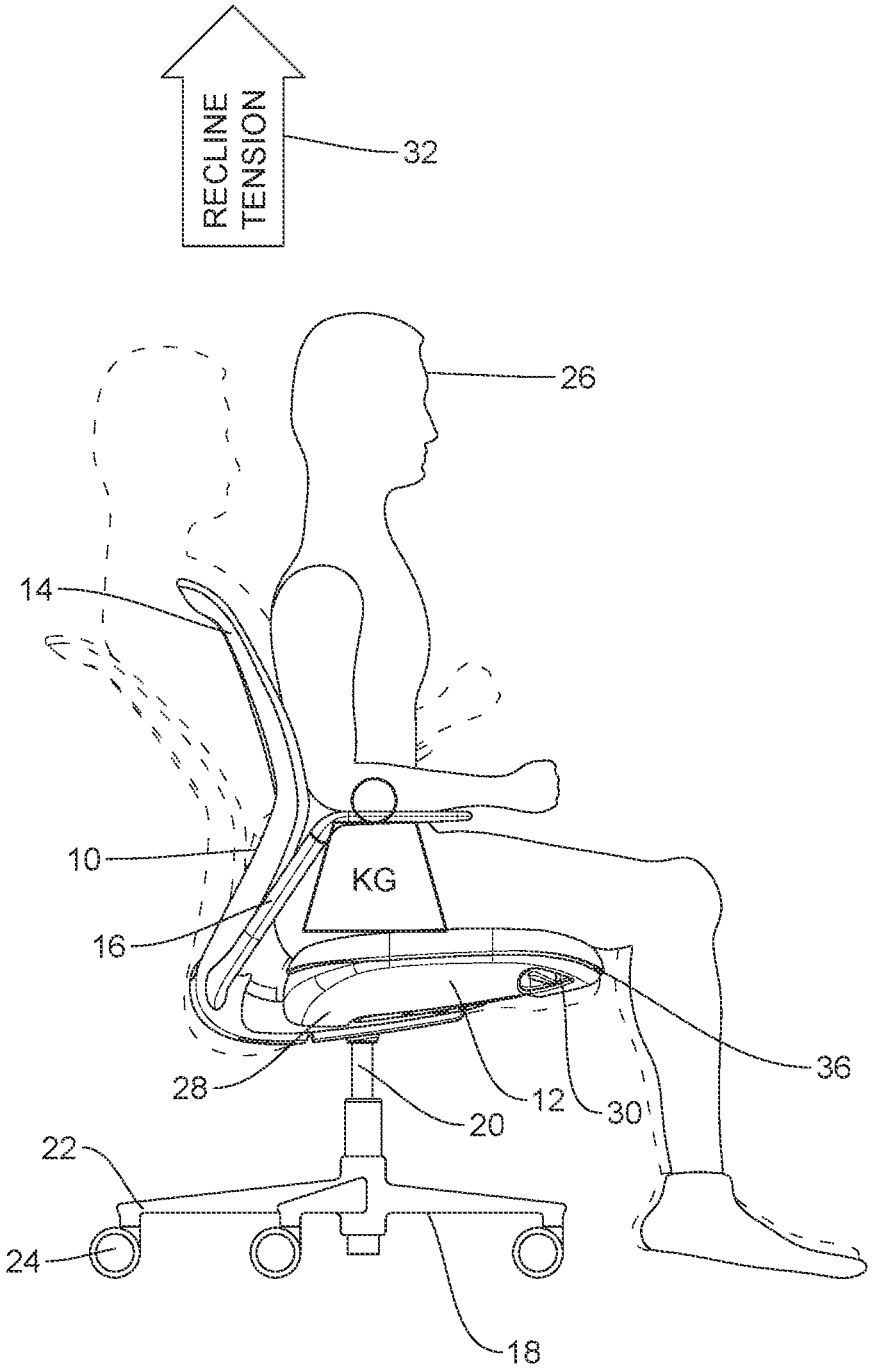
FIG. 1 is a side elevational view of a chair with an occupant seated therein with good upright posture according to an embodiment.
Figure 2:
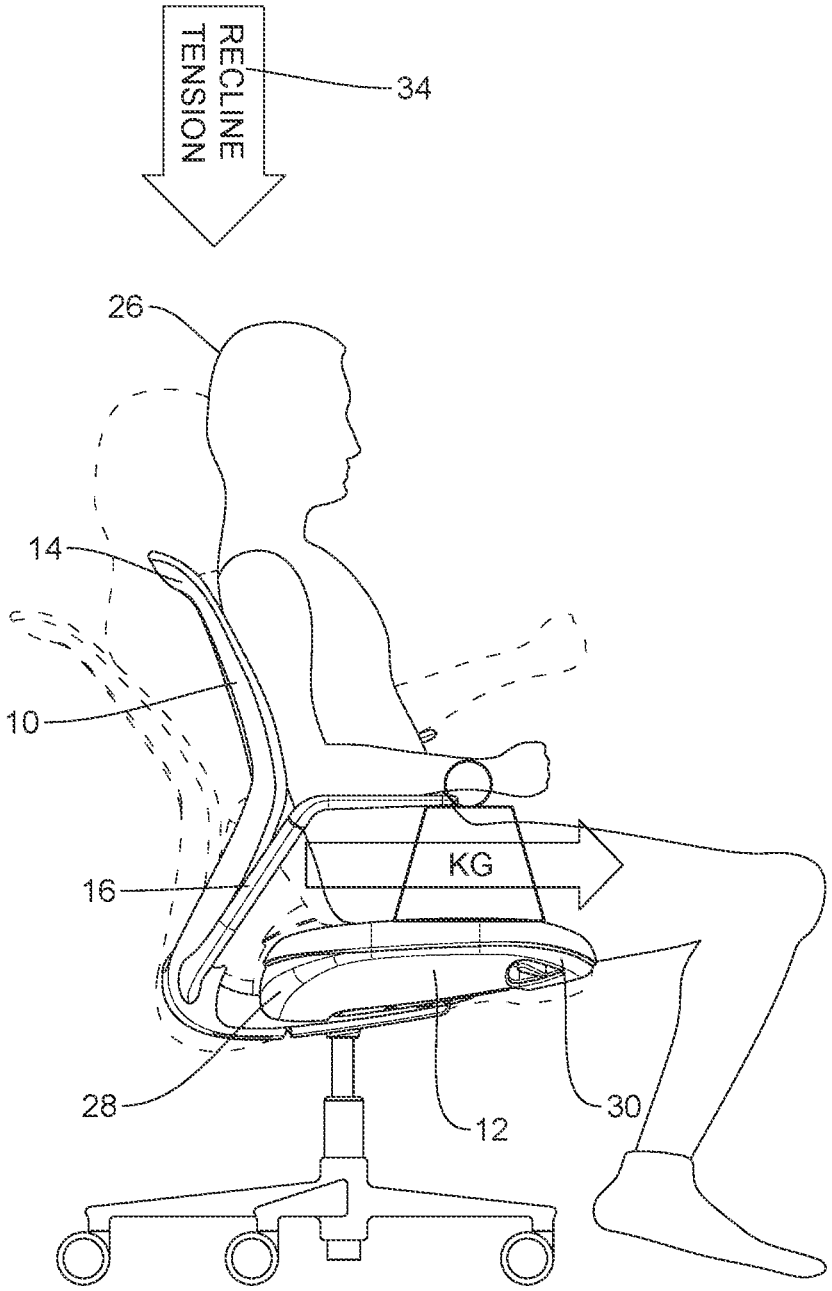
FIG. 2 is a side elevational view of a chair with an occupant seated therein with poor slouched posture according to an embodiment.

A chair 10, which may be a task office chair, is shown in FIGS. 1 and 2. The chair 10 includes a seat 12 and a backrest 14. In addition, for this embodiment, the chair 10 includes armrests 16 and support structure 18 including a central support post 20 and four lower legs 22 each having a wheel 24.

The chair 10 can be positioned in an upright position (as shown in dark grey in FIGS. 1 and 2) and a reclined position (as shown in light grey in FIGS. 1 and 2). This can be accomplished by the seated occupant leaning backward against the backrest 14 of the chair 10 to exert a force on the backrest 14 that is sufficient to cause the backrest 14 to pivot in a rearward direction. The recline motion provided by chair 10 is capable of being started with ease and can stop softly for every sized person and can provide fluidic, responsive movement.

In FIG. 1, the occupant 26 of the chair is seated upright with good posture in the chair 10, and in FIG. 2, the occupant 26 is shown slouched within the chair in relatively poor posture. Accordingly, as shown in FIGS. 1 and 2 with the designation "KG", the weight (i.e., center of gravity) of the occupant 26 applied to the chair 10 is applied to the rear portion 28 of the seat 12 in FIG. 1, whereas the weight (i.e., center of gravity) of the occupant 26 is centered and applied on the front portion 30 of the seat 12 in FIG. 2.

According to an embodiment, the chair 10 is configured to provide synchronous-tilting that not only is able to account for the occupant's weight applied to the seat 12, but also able to account for the occupant' posture in the chair 10 to automatically adjust recline tension. Here, recline tension refers to the amount of force required to be applied to the backrest by the occupant of the chair to cause the backrest to recline. Recline tension must be sufficiently strong so as to prevent unwanted recline movement by an upright seated occupant.

By way of example, for a given occupant of a given weight, recline tension is automatically set at an appropriate level (i.e., a level that prevents unintended reclining, but that is not too strong as to cause injury to an occupant attempting to recline the chair) based on occupant weight when the occupant has good upright seating posture as shown in FIG. 1. This is accomplished by a synchronous-tilt configuration that takes into account the weight of the occupant and that the weight of the occupant is being applied essentially to the rear portion 28 of the seat 12. However, if the same occupant (i.e., the same weight is being applied to the seat) assumes a slouched position on the chair 10 as shown in FIG. 2 and the weight of the occupant is shifted and applied to the front portion 30 of the seat 12, recline tension is automatically reduced by chair 10. For instance, see arrow 32 in FIG. 1 which shows that the reline tension is relatively high for the occupant seated with good posture, and see the arrow 34 in FIG. 2 which shows that recline tension is relatively less when the same occupant (i.e., of the same weight) is seated with poor posture.

Thus, when the occupant 26 is sitting with good posture, at a healthy position for maximum core strength, the recline tension provided by the chair 10 is automatically set to appropriately balance recline tension with occupant weight. This weight-sensing feature does not require manual recline tension adjustment and is automatically tensioned correctly for each user.

In comparison, when the occupant 26 is sitting with poor posture (i.e., slid forward in the seat and slouched), the occupant 26 is considered to be at a relatively unhealthy sitting position. If recline tension remains the same for the same occupant seated as shown in both FIGS. 1 and 2, too high an amount of pressure will be exerted on the lower back of the occupant in FIG. 2 when the occupant attempts to recline the chair. Thus, according to an embodiment, the amount of recline tension provided by the chair 10 automatically decreases as the occupant's weight is shifted forward on the seat 12. This reduces pressure applied to the occupant's lower back upon recline and thereby reduces risk of injury.

Accordingly, the chair 10 provides seating that is healthy even when users or occupants slouch throughout the day. In addition, the above referenced feature results in providing the occupant with subtle feedback to which the occupant can react. For instance, as recline tension drops, the occupant's reaction is typically to scoot back in the seat thereby promoting and creating a more upright and healthy posture.

Figure 3:
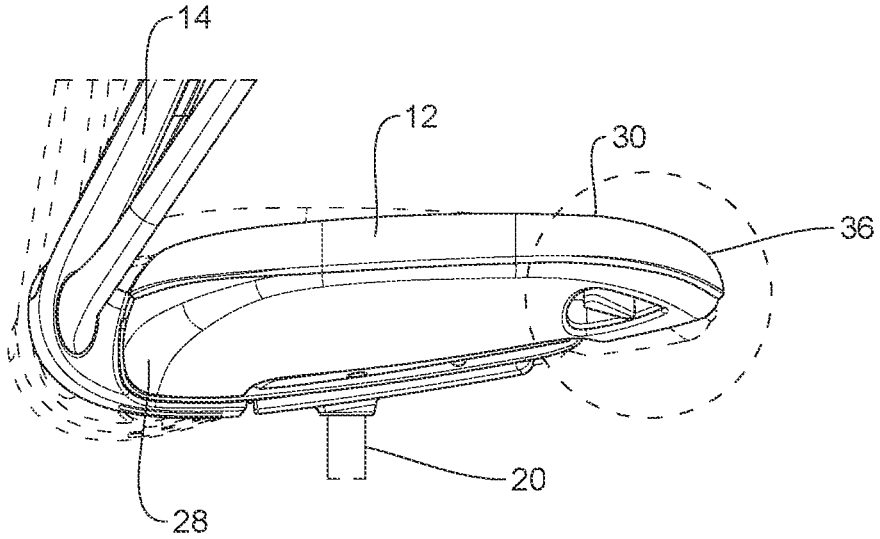
FIG. 3 is a side elevational view of a chair according to an embodiment.

Further, the motion of the seat 12 when the backrest 14 is reclined, relieves pressure under the legs of the occupant behind his/her knees to prevent any restriction of blood flow to the legs. For instance, as shown in FIG. 3, when the chair 10 is an upright, normal, or non-reclined position (as shown in dark grey in FIG. 3), the front edge 36 of the seat 12 is higher in elevation then when the chair 10 is in a reclined position (as shown in light grey in FIG. 3). Thus, this automatic drop in elevation of the front edge 36 of the seat 12 during recline, relieves pressure under the legs of the occupant supported on the front edge 36.

Figure 4:
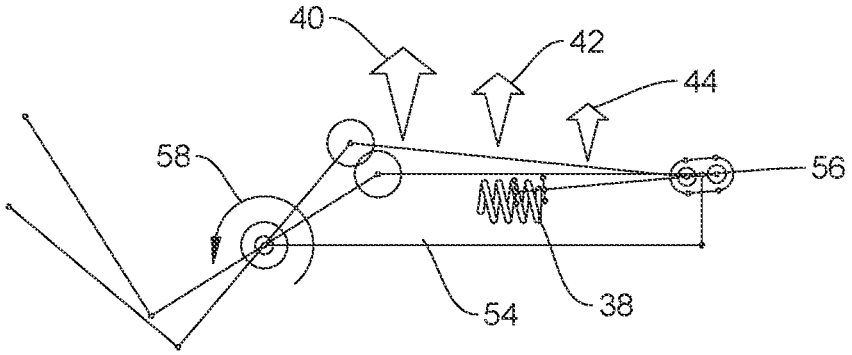
FIG. 4 is a schematic view of a sliding-block linkage according to an embodiment.

According to an embodiment, the recline tension of the chair 10 is controlled by the amount of weight being applied to the seat 12 and where on the seat 12 the weight is being applied (i.e., toward the rear or front of the seat 12) along with a force provided by a helper or tensioning spring 38. For instance, as shown in FIG. 4, when the weight is applied over the rear portion of the seat 12, recline tension is relatively high (see arrow 40). In contrast, when the same weight is applied over the center of the seat 12, recline tension becomes relatively less (see arrow 42), and when the same weight is applied over the front portion of the seat 12, recline tension is further reduced (see arrow 44).

Figure 5:
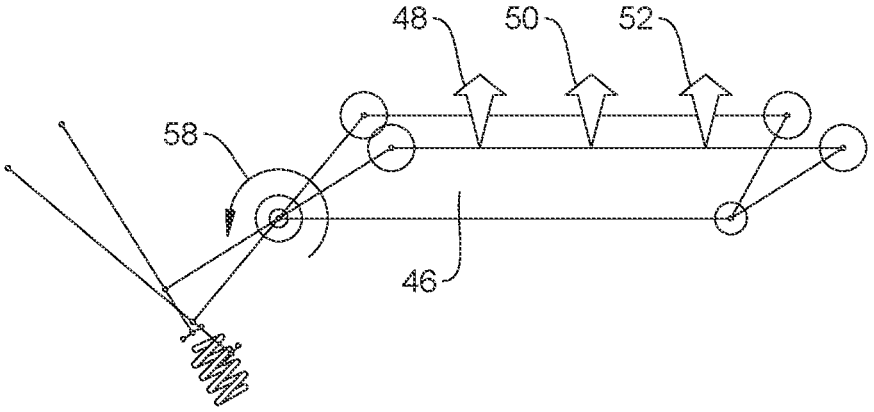
FIG. 5 is a schematic view of a four-bar linkage according to the prior art.

In comparison, weight sensing chairs using some form of a parallelogram, or four-bar linkage 46, to raise and lower the seat is shown in FIG. 5. When the weight of the occupant is centered over the rear portion of the seat, the center of the seat, or the front portion of the seat, reline tension (see arrows 48, 50 and 52) remains the same for the same occupant weight. Also, the front edge of the seat in FIG. 5 is raised when the backrest is reclined and thereby undesirably exerts pressure under the legs of the occupant which can restrict blood flow to the legs of the occupant.

A sliding-block linkage 54 according to an embodiment is shown in FIG. 4. The sliding block linkage 54 includes a front pivot point or axis 56 that remains fixed in height from the floor on which the chair 10 is supported. Accordingly, the seat front edge 36 (i.e., the part of the seat at or extending forward of the front pivot point 56) is not lifted or elevated during incline. The front edge 36 of the seat 12 forward of the front pivot point 56 lowers or drops in elevation when the backrest 14 is reclined and thereby automatically relieves pressure behind the knees of the occupant.

As shown in FIG. 4, as the backrest 14 is rotated rearward (see arrow 58), the angle of the seat 12 changes (i.e., it tilts about the front pivot point or axis 56). Thus, the seat 12 lifts in the rear and drops in the front. In addition, the further the occupant's weight (i.e., center of gravity) is located rearward on the seat 12, the higher the amount of recline tension will be automatically generated by the chair 10 to balance the backrest 14.

Figure 6A:
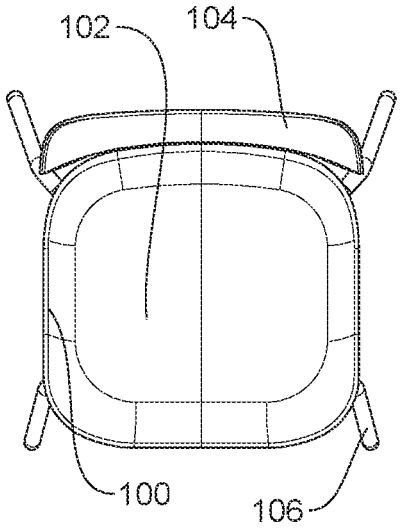
FIGS. 6A-6D are plan and side elevational views of an office side chair in upright and reclined positions according to an embodiment.

An embodiment of a side office chair 100 is shown in FIGS. 6A-9C. As best shown in FIG. 6A, chair 100 includes a seat 102, a backrest 104, and four legs 106, one at each corner of the seat 102. In addition, as best shown in FIGS. 6B and 6D, the seat 102 includes an upper seat section 110 providing a seating surface 108 and a lower seat section or seat base 112.

Figure 6B:
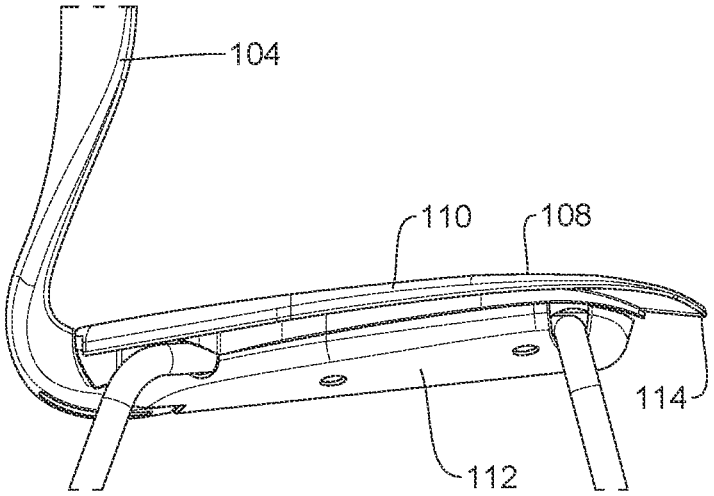
Figure 6C:
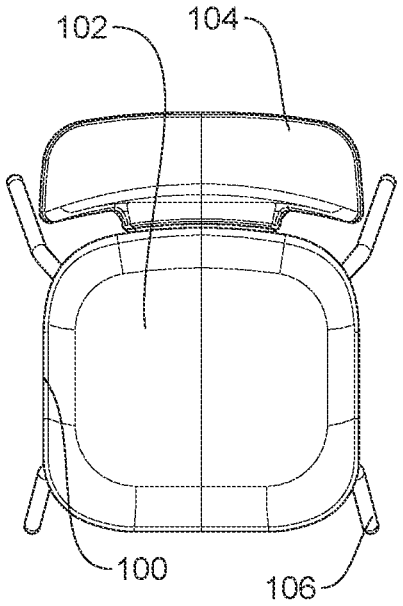
Figure 6D:
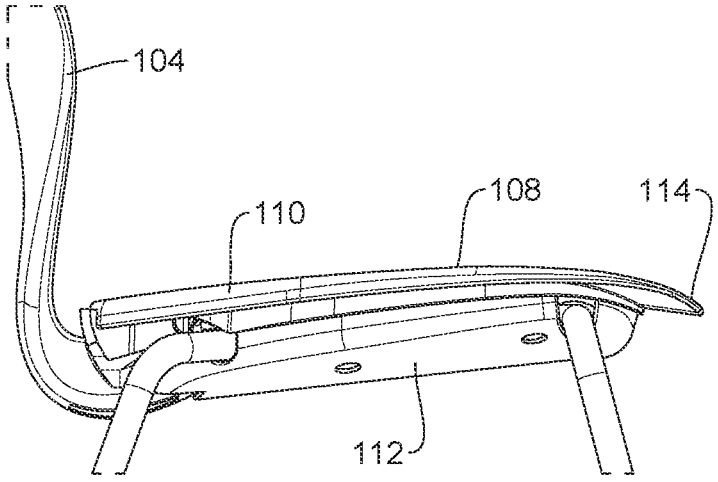

FIGS. 6A and 6B show the chair 100 in an upright, normal, non-reclined position. In contrast, FIGS. 6C and 6D show the chair 100 in a reclined position. The legs 106 and the seat base 112 remain stationary regardless of the chair 100 being in the non-reclined or reclined position. As best shown in FIG. 6B, in the recline position, the backrest 104 pivots rearward and the upper seat section 110 moves such that the rear of the upper seat section 110 is lifted upward and the front edge 114 of the upper seat section drops slightly in elevation.

Figure 7A:
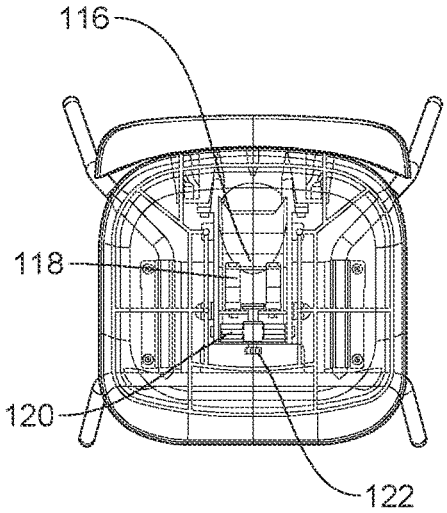
FIGS. 7A-7D are plan and side elevational views of an office side chair in upright and reclined positions and schematically showing operation of the sliding block linkage according to an embodiment.
Figure 7B:
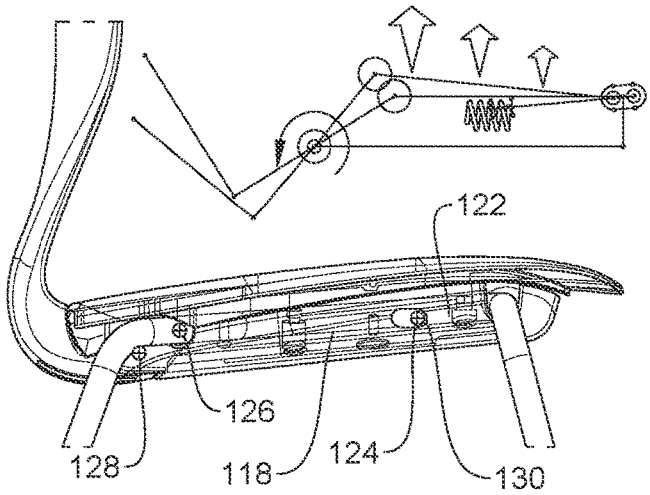
Figure 7C:
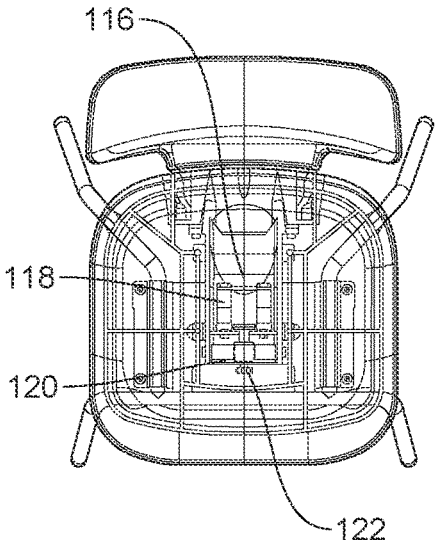
Figure 7D:
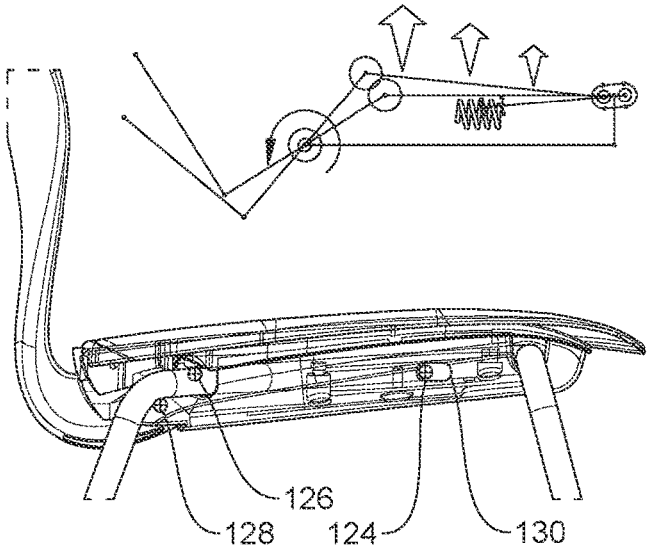

FIGS. 7A-7D show the synchronous-tilt mechanism, arrangement, or configuration 116 that enables the chair 100 to recline as discussed above. FIGS. 7A and 7B show the chair 100 in the non-reclined position, and FIGS. 7C and 7D show the chair 100 in the reclined position.

The mechanism 116 includes a pair of tensioning springs 118 contained within the seat 102. The springs 118 extend parallel to each other and in a direction from front-to-back of the chair. The rear of the springs 118 are mounted in a stationary position to the seat base 112 and the front of springs 118 interconnect to a bar 120 or the like extending in front of and perpendicular to the springs 118. A tensioning screw 122 is connected to the bar 120 and permits some manual fine adjustment to the amount of recline tension provided by the mechanism 116.

The mechanism 116 defines a seat front pivot axis 124 about which the upper seat section 110 pivots relative to the stationary seat base 112 adjacent the front of the seat 102, a seat rear pivot axis 126 about which the rear of the upper seat section 110 pivots relative to the backrest 104, and a stationary backrest pivot axis 128 about which the backrest 104 pivots.

The bar 120 can define the seat front pivot axis 122 and hinge connection used to connect the upper seat section 110 to the seat base 112. The opposite ends of the bar 120 can extend within relatively short travel slots 130. Accordingly, as shown in FIG. 7B, the seat front pivot axis 124 is located forward within the travel slot 130 when the chair 100 is in the normal, non-reclined position, and as shown in FIG. 7D, the seat front pivot axis 124 is located rearward in the travel slot 130 when the chair 100 is in the recline position. With this mechanism or arrangement 116, the recline tension automatically increases when occupant weight increases and reduces when occupant weight decreases. In addition, the recline tension automatically reduces when an occupant slouches forward in the chair 100 such that occupant's weight (i.e., center of gravity) is centered over a forward part of the seat 102 as discussed above.

Figure 8A:
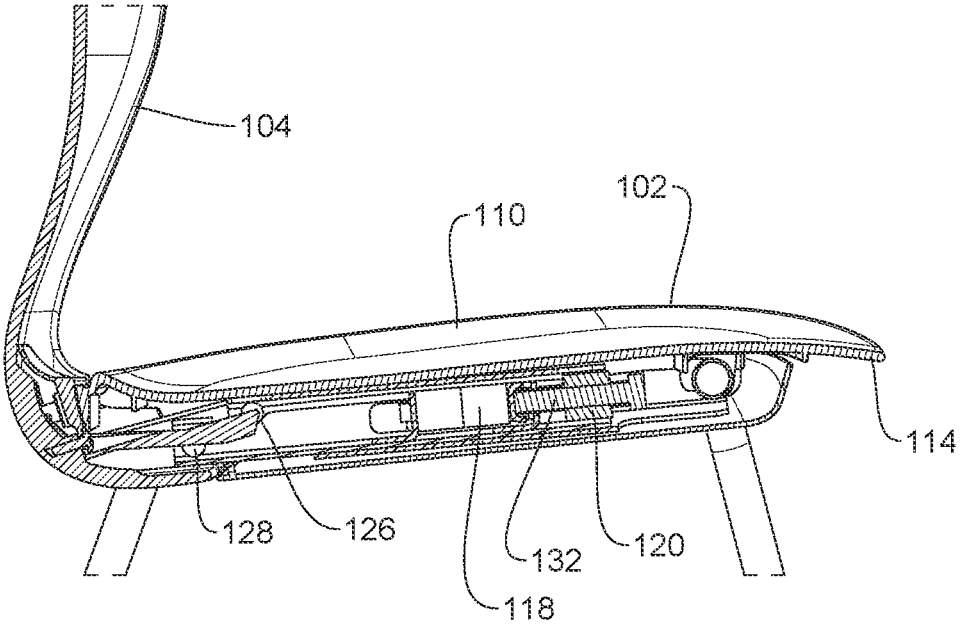
FIGS. 8A-8B are cross-sectional views of an office side chair in upright and reclined positions according to an embodiment.
Figure 8B:
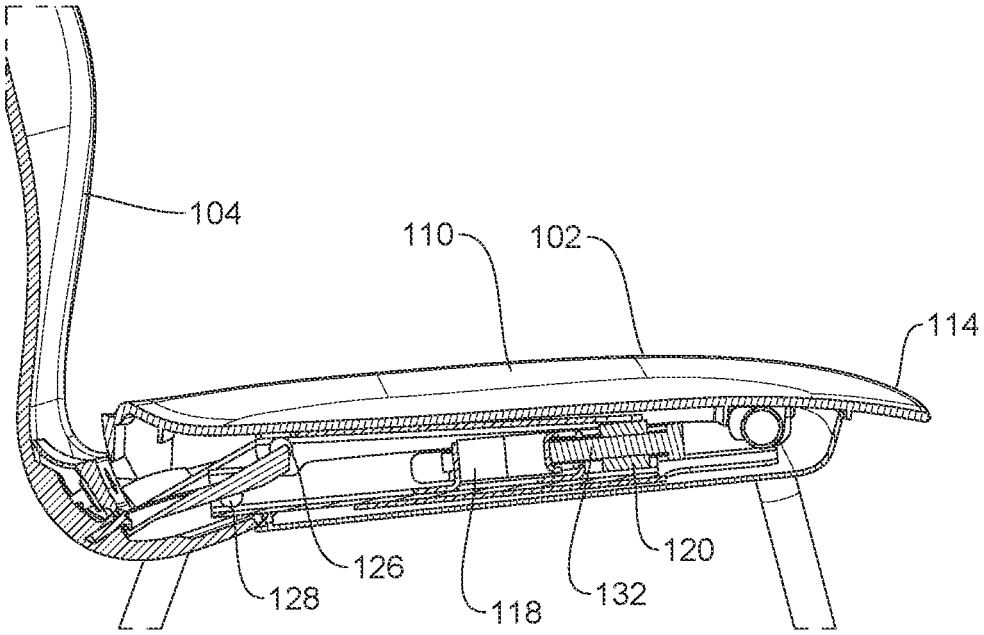

FIGS. 8A and 8B show a cross-section of the chair 100 in a normal, non-reclined position and in a reclined position. The springs 118 are acted upon by a plunger 132 interconnected to the bar 120. When the chair 100 is in the non-reclined position of the chair 100 (see FIG. 8A), the plunger 132 presses against the springs 118, and when the chair 100 is in the reclined position (see FIG. 8B), the plunger 132 is forced further toward the springs 118 to further compress the springs 118. This force combined with the occupant's weight and occupant's position on the seat defines the sets tension. As the backrest 104 is pivoted rearward about the stationary backrest pivot axis 128, the rear of the upper seat section 110 becomes elevated as is the seat rear pivot axis 128 and the springs 118 become compressed. In addition, the front edge 114 of the upper seat section 110 is lowered as the upper seat section 110 pivots about the front seat pivot axis 124. The force of the springs 118 position the chair 100 in the normal, non-reclined position when there is no occupant in the chair or when the occupant no longer leans rearward in the chair.

Figure 9A:
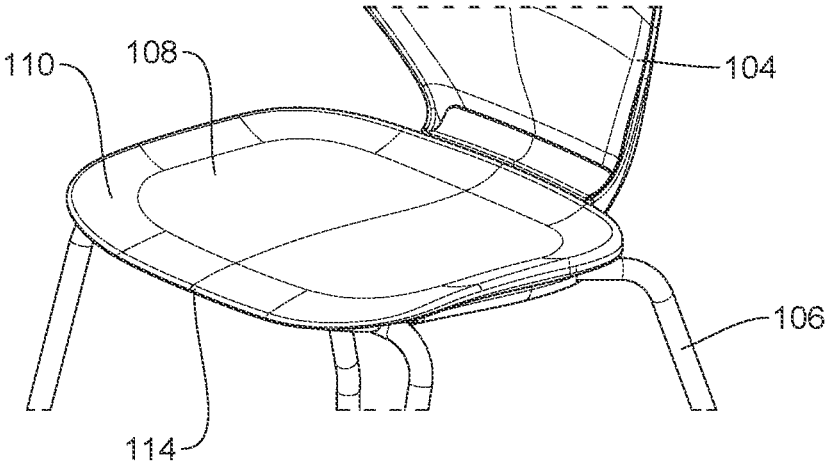
FIGS. 9A-9C are perspective views of the seat portion of the side chair with seat covering applied and with the seat covering removed when the side chair is in upright and reclined positions according to an embodiment.
Figure 9B:
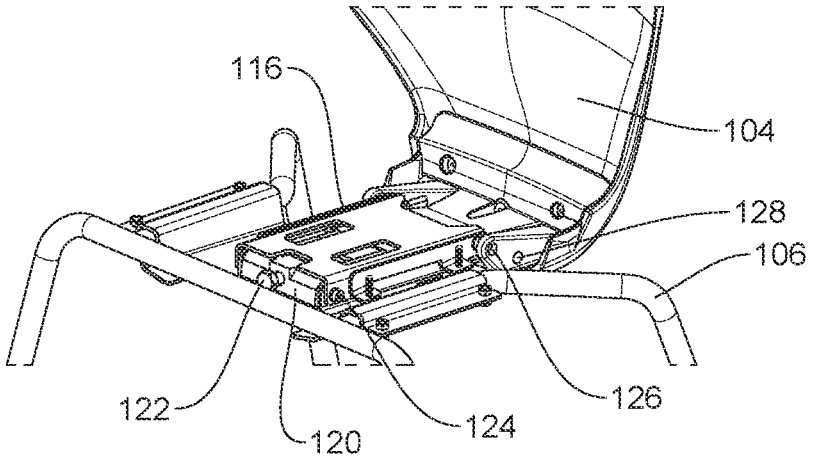
Figure 9C:
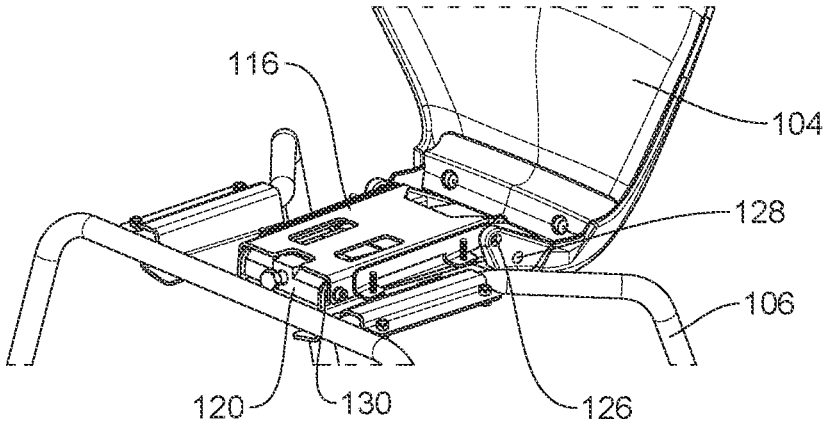

FIG. 9A shows the upper seat section 110 in the non-reclined position. The upper seat section 110 provides an upper covering for the seat 102 and moves as discussed above. FIG. 9B shows the mechanism 116 with the upper seat section 110 removed and with the chair in the normal, non-reclined position. FIG. 9C shows the mechanism 116 with the upper seat section 110 removed and with the chair 100 in the reclined position. By comparing FIGS. 9B and 9C, it is shown that the backrest 104 pivots about the stationary backrest pivot axis 128 and that the rear of the upper seat section 110 is connected to and pivots relative to the backrest 104 about the seat rear pivot axis 126 and is thereby elevated when the chair 100 is reclined. In addition, it is shown that the seat front pivot axis 124 travels rearward in the travel slot 130 during chair recline, but remains at about the same height above the floor. Thus, the upper seat section 110 pivots about the seat front pivot axis 124 and therefore the front edge 114 of the upper seat section 110 drops in elevation during chair recline. Also, due to the rearward movement of the seat front pivot axis 124, the springs 118 (which are mounted in a stationary position to the seat base 112) become further compressed as the chair is reclined and provides a force in an opposite direction that urges the seat front pivot axis toward the front of the travel slot 130.

Figure 10A:
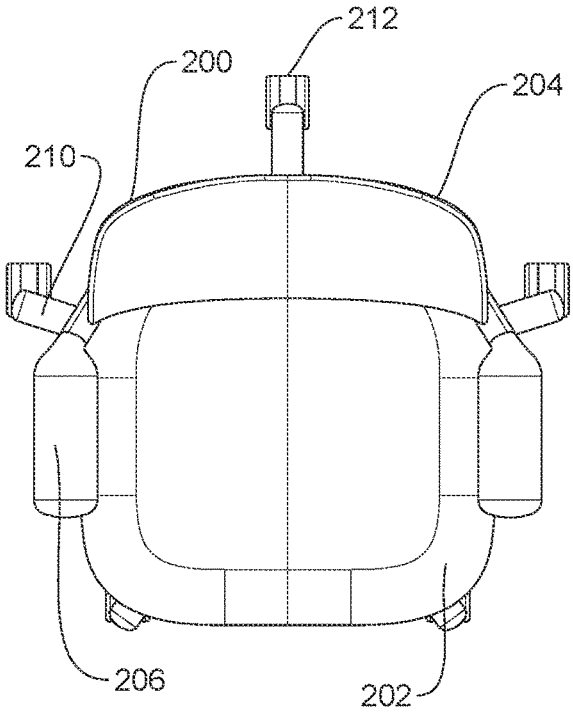
FIGS. 10A-10D are plan and side elevational views of an office task chair in upright and reclined positions according to an embodiment.

An embodiment of a task office chair 200 is shown in FIGS. 10A-13C. As best shown in FIG. 10A, chair 200 includes a seat 202, a backrest 204, armrests 206, a central support post 208 that extends to at least four legs 210 having wheels 212. In addition, as best shown in FIGS. 10B and 10D, a seat support plate or seat base 214 is connected to the upper end of the support post 208.

Figure 10B:
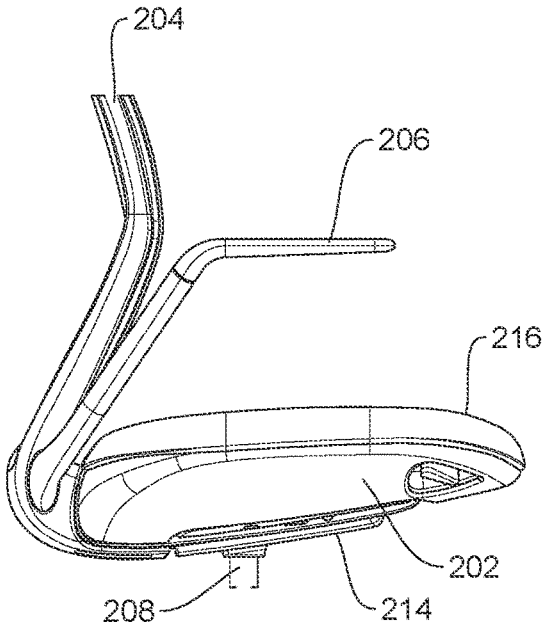
Figure 10C:
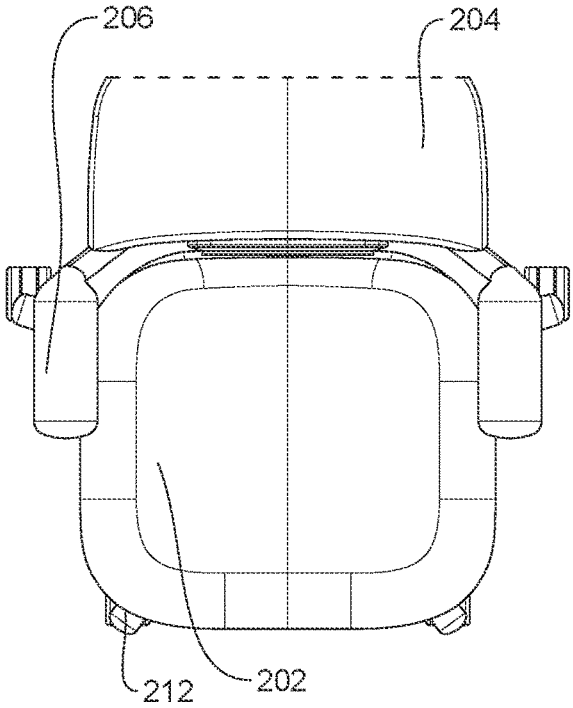
Figure 10D:
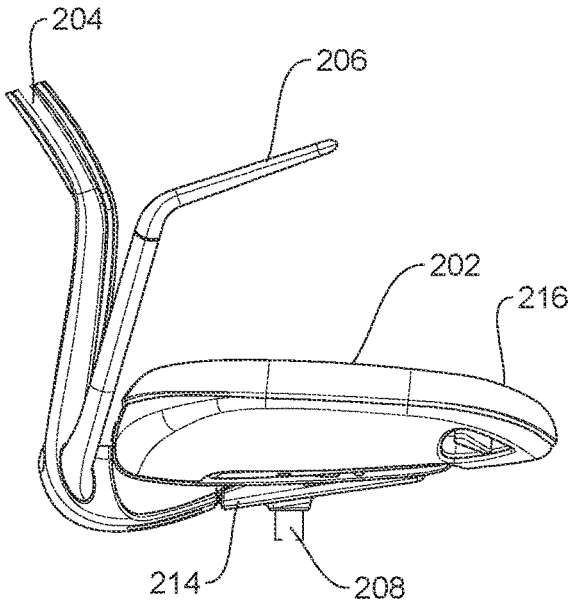

FIGS. 10A and 10B show the chair 200 in an upright, normal, non-reclined position. In contrast, FIGS. 10C and 10D show the chair 200 in a reclined position in which the backrest 204 is pivoted rearward and the rear of the seat 202 elevates while front edge 216 of the seat 202 drops slightly in elevation.

Figure 11A:
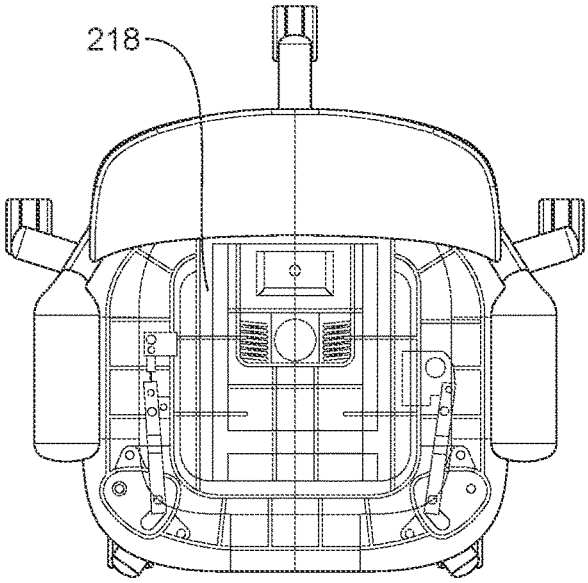
FIGS. 11A-11D are plan and side elevational views of an office task chair in upright and reclined positions and schematically showing operation of the sliding block linkage according to an embodiment.
Figure 11B:
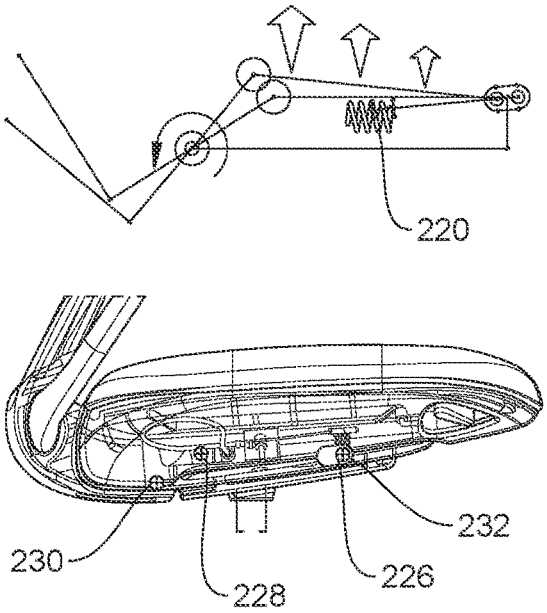
Figure 11C:
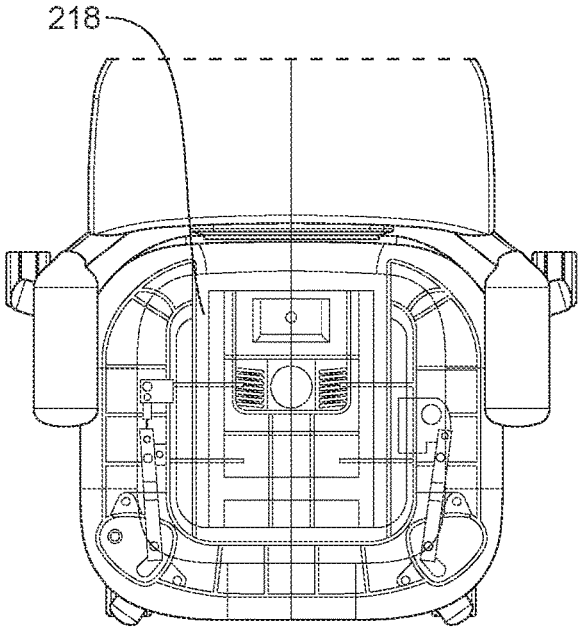
Figure 11D:
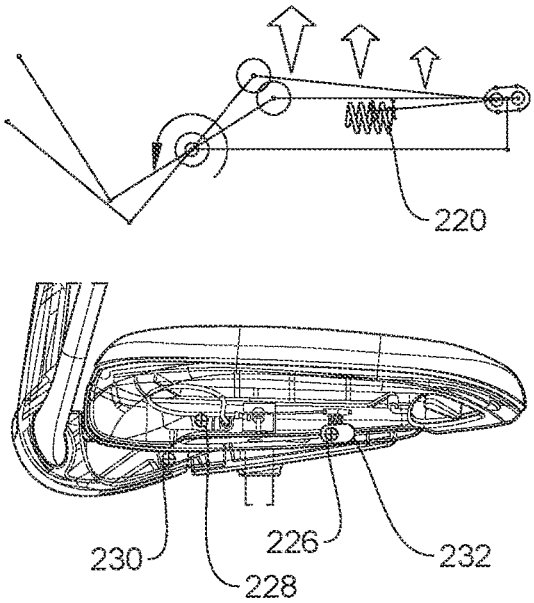

FIGS. 11A-11D show the synchronous-tilt mechanism, arrangement, or configuration 218 that enables the chair 200 to recline as discussed above. FIGS. 11A and 11B show the chair 200 in the non-reclined position, and FIGS. 11C and 11D show the chair 200 in the reclined position.

Figure 12A:
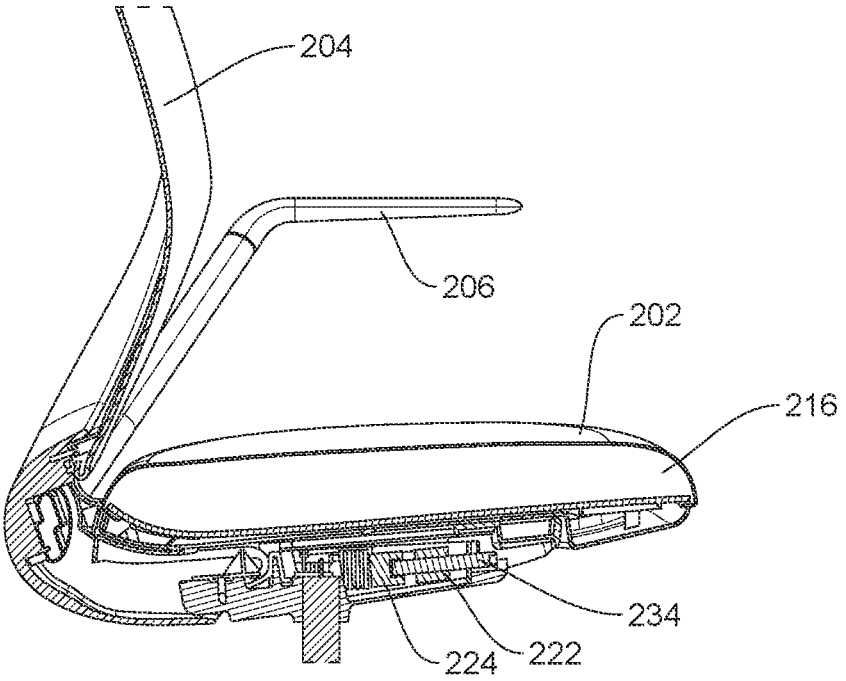
FIGS. 12A-12B are cross-sectional views of an office task chair in upright and reclined positions according to an embodiment.
Figure 12B:
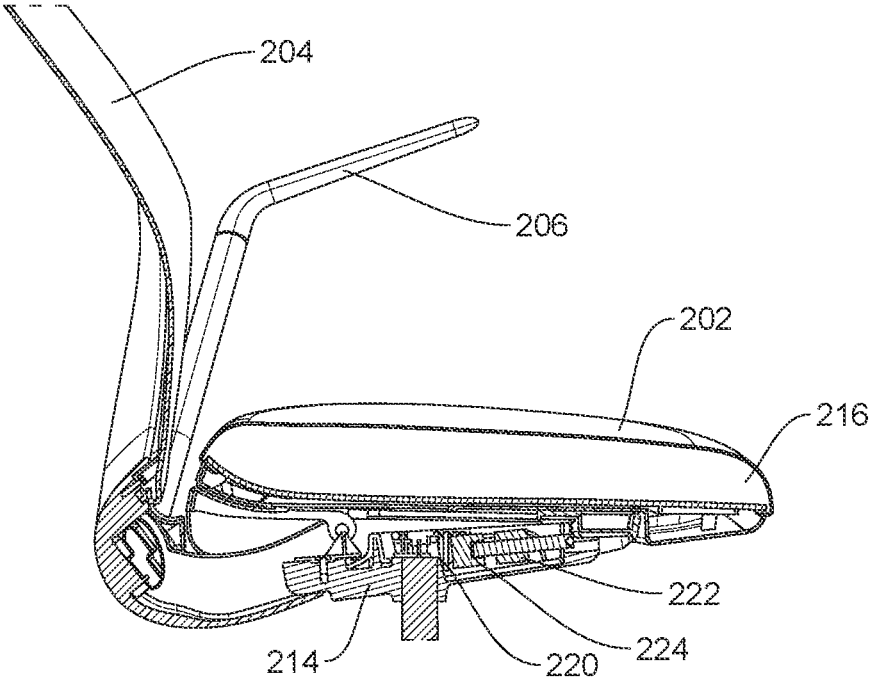

As shown in FIGS. 12A and 12B, the mechanism 218 includes a pair of tensioning springs 220 contained on the seat base 214. The springs 220 extend parallel to each other and in a direction from front-to-back of the chair 200. The rear of the springs 220 are mounted in a stationary position on the seat base 214 and the front of the springs 220 interconnect via a plunger 224 to a bar 222 or the like extending in front of and perpendicular to the springs 220. A tensioning screw 234 can be connected to the bar 222 to permit some manual fine adjustment to the amount of recline tension provided by the mechanism 218.

The mechanism 218 defines a seat front pivot axis 226 about which the seat 102 pivots adjacent the front of the seat 102, a seat rear pivot axis 228 about which the rear of the seat 102 pivots relative to the backrest 204, and a stationary backrest pivot axis 230 about which the backrest 204 pivots.

The bar 222 can define the seat front pivot axis 226 and provide a hinged connection. The ends of the bar 222 can extend within a relatively short stationary travel slots 132. Accordingly, as shown in FIG. 11B, the seat front pivot axis 226 is located forward within the travel slots 232 when the chair is in the normal, non-reclined position, and as shown in FIG. 11D, the seat front pivot axis 226 is located rearward in the travel slots 232 when the chair 200 is in the recline position. With this mechanism 218, the recline tension automatically increases when occupant weight increases and reduces when occupant weight decreases. In addition, the recline tension automatically reduces when an occupant slouches forward in the chair 200 such that occupant's weight is centered over a forward part of the seat 202 as discussed above.

FIGS. 12A and 12B show a cross-section of the chair 200 in a normal, non-reclined position and in a reclined position. The springs 220 are acted upon by the plunger 224 that is interconnected to the bar 222. When the chair 200 is in the non-reclined position (see FIG. 12A), the plunger 224 lightly press against the springs 220, and when the chair 200 is in the reclined position (see FIG. 12B), the plunger 224 is forced further toward the springs 220 to compress the springs 220. The force generated by the springs 220 combined with the occupant's weight and occupant's position on the seat 102 automatically adjusts the recline tension. As the backrest 204 is pivoted rearward about the stationary backrest pivot axis 230, the rear of the seat 202 is elevated as is the seat rear pivot axis 228 and the springs 220 become compressed. In addition, the front edge 216 of the seat 202 is lowered as the seat 202 pivots about the front seat pivot axis 226. The force of the springs 220 position the chair in the normal, non-reclined position when there is no chair occupant or the occupant ceases to lean rearward in the chair.

Figure 13A:
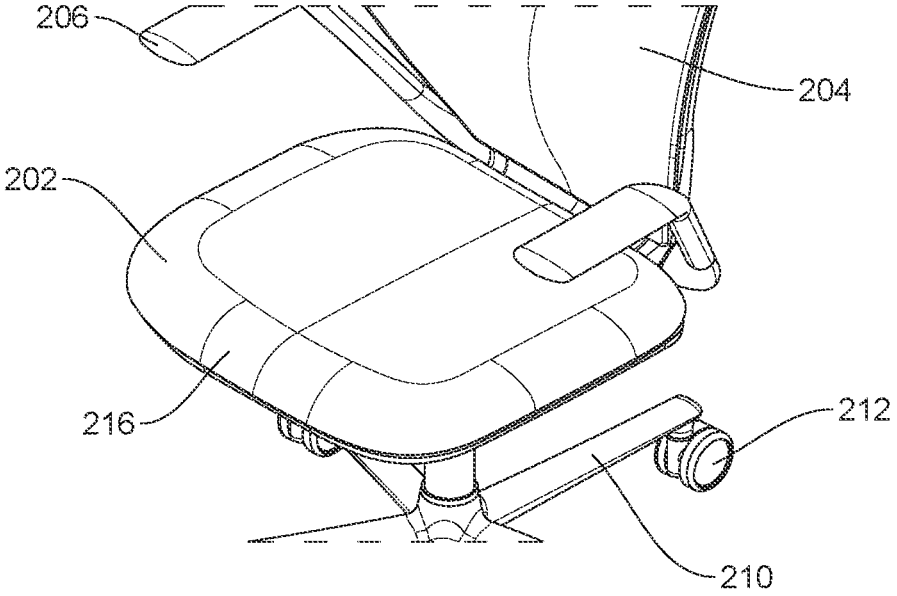
FIGS. 13A-13C are perspective views of the seat portion of the task chair with seat covering applied and with the seat covering removed when the task chair is in upright and reclined positions according to an embodiment.
Figure 13B:
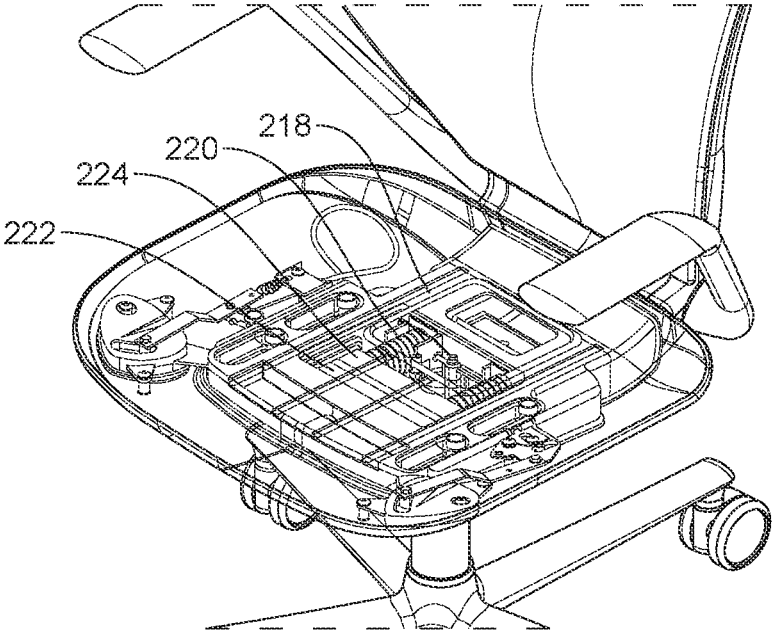
Figure 13C:
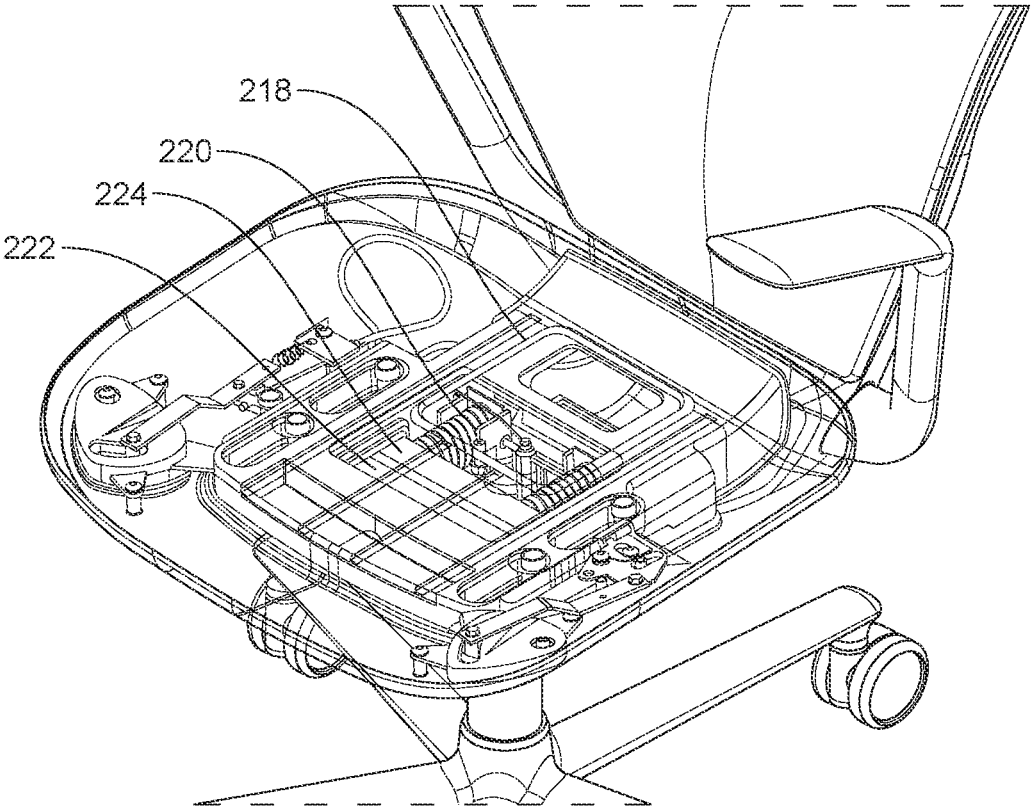

FIG. 13A shows a top of the seat 202 in the non-reclined position. FIG. 13B shows the mechanism 218 beneath the seat 202 and with the chair 200 in the normal, non-reclined position. FIG. 13C shows the mechanism 218 beneath the seat 202 and with the chair 200 in the reclined position. By comparing FIGS. 13B and 13C, it is shown that the backrest 204 pivots about the stationary backrest pivot axis 230 and that the rear of the seat 202 is connected to and pivots relative to the backrest 204 about the seat rear pivot axis 228 and is thereby elevated when the backrest 204 is reclined. In addition, it is shown that the seat front pivot axis 226 travels rearward in the travel slots 232 during chair recline, but remains at about the same height above the floor. Thus, the seat 202 pivots relative to the seat front pivot axis 226 and therefore the front edge 216 of the seat 202 drops in elevation during chair recline. Also, due to the rearward movement of the seat front pivot axis 226, the springs 220 (which are mounted in a stationary position to the seat base 214) become compressed as the chair 200 is reclined and provides a force in an opposite direction that urges the seat front pivot axis 226 toward the front of the travel slots 232.

The task chair 200 may be provided with additional features. A handle underneath the seat may be provided to enable the seat to be slid forward for manual seat depth adjustment. Thus, as needed by the end user, the seat can be positioned closer to or further away from the backrest. In addition, a further handle located underneath the seat may adjust the chair height, (i.e., to effectively increase or decrease the length of the support post). These handles may be on opposite sides of the seat underneath the seat. Further, the arm rests may be adjustable so that they can be raised and lowered in height via a trigger under the arms of the arm rests.

The various components described above may be made of metallic, non-metallic, wooden, plastic, resins, composite, fabric or like materials. The above description illustrates embodiments of how aspects of the present invention may be implemented, and are presented to illustrate the flexibility and advantages of particular embodiments as defined by the following claims, and should not be deemed to be the only embodiments. One of ordinary skill in the art will appreciate that based on the above disclosure and the following claims, other arrangements, embodiments, implementations, and equivalents may be employed without departing from the scope hereof as defined by the claims.

Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims.

We claim:

1. A chair, comprising:

a seat base;

a backrest interconnected to said seat base via a hinge connection and movable relative to said seat base about a backrest pivot axis between a normal non-reclined position and a reclined position;

a seat supported on said seat base and having a rear portion adjacent said backrest and a front portion defining a front edge of said seat;

said rear portion of said seat being interconnected to said backrest via a hinge connection such that as said backrest is pivoted to the reclined position, said rear portion pivots relative to said backrest about a seat rear pivot axis and is elevated;

said front portion of said seat being interconnected to said seat base via a hinge connection such that said seat is movable about a seat front pivot axis and such that as said backrest is pivoted to the reclined position and said rear portion of said seat is elevated, said seat pivots about said seat front pivot axis causing said front edge of said front portion of said seat to be lowered; and at least one tensioning spring, a plunger for engaging said at least one tensioning spring, and a front support bar that interconnects to said plunger and defines said seat front axis pivot axis.

2. The chair according to claim 1, wherein said at least one tensioning spring is mounted on said seat base beneath said seat such that a rear end of said tensioning spring is mounted to said seat base in a stationary position relative to said seat base.

3. The chair according to claim 2, wherein said front support bar extends within at least one slot formed by said seat base such that, as said backrest is pivoted to the reclined position and said rear portion of said seat is raised and said front portion of said seat is lowered, said front support bar moves to a rearward location within said at least one slot causing said plunger to compress said at least one tensioning spring.

4. The chair according to claim 3, wherein, when said backrest is pivoted to the normal non-reclined position, said rear portion of said seat is lowered, said front portion of said seat is raised, said front support bar moves to a forward location within said at least one slot, and said tensioning spring expands.

5. The chair according to claim 4, wherein said slot extends substantially horizontally such that said seat front pivot axis remains at a substantially constant elevation when said backrest is in said normal non-reclined position and said reclined position.

6. The chair according to claim 5, wherein said seat rear pivot axis raises in elevation when said backrest is pivoted from said normal non-reclined position to said reclined position.

7. The chair according to claim 6, wherein recline tension provided by said chair is a function of a force required to compress said at least one tensioning spring, a weight applied to said seat by a seat occupant, and a location of said weight applied to said seat relative to said front portion and rear portion of said seat, such that, as said weight is applied toward said front portion of said seat, said recline tension is reduced and, as said weight is applied toward said rear portion of said seat, said recline tension is increased.

8. The chair according to claim 1, wherein said at least one tensioning spring includes a pair of tensioning springs extending adjacent and parallel to each other.

9. The chair according to claim 1, further comprising a set of legs connected to said seat base for supporting said seat base above a floor surface.

10. The chair according to claim 1, further comprising a central support post connected to said seat base for supporting said seat base.

11. The chair according to claim 1, further comprising a pair of armrests extending from said backrest.

12. A synchronous-tilt reclining office chair, comprising:

a seat;

a backrest interconnected to said seat; and a synchronous-tilt mechanism that controls synchronous movement of said backrest and said seat between a normal non-reclined position and a reclined position such that recline tension is a function of a force required to compress at least one tensioning spring mounted below said seat, a weight applied to said seat by a seat occupant, and a location of said weight applied to said seat relative to front and rear portions of said seat, whereby, as said weight is applied toward said front portion of said seat, said recline tension is reduced and, as said weight is applied toward said rear portion of said seat, said recline tension is increased;

wherein the synchronous-tilt mechanism includes an arrangement comprising said backrest being interconnected to a seat base and movable relative to said seat base about a backrest pivot axis between a normal non-reclined position and a reclined position, said rear portion of said seat being interconnected to said backrest such that as said backrest is pivoted to the reclined position, said rear portion of said seat is elevated, and said front portion of said seat being interconnected to said seat base such that said seat is movable about a seat front pivot axis and such that as said backrest is pivoted to the reclined position and said rear portion of said seat is raised, said seat pivots about said seat front pivot axis and causes a front edge of said front portion of said seat to be lowered;

wherein said at least one tensioning spring is mounted on said seat base beneath said seat such that a rear end of said at least one tensioning spring is mounted to said seat base in a stationary position relative to said seat base; and wherein the synchronous-tilt mechanism includes a plunger for engaging said at least one tensioning spring and a front support bar that interconnects to said plunger and defines said seat front axis pivot axis.

13. The synchronous-tilt reclining office chair according to claim 12, wherein said front support bar extends within at least one slot formed by said seat base such that, as said backrest is pivoted to the reclined position and said rear portion of said seat is raised and said front portion of said seat is lowered, said front support bar moves to a rearward location within said at least one slot causing said plunger to compress said at least one tensioning spring, and wherein, when said backrest is pivoted to the normal non-reclined position, said rear portion of said seat is lowered, said front portion of said seat is raised, said front support bar moves to a forward location within said at least one slot, and said tensioning spring expands.

14. The synchronous-tilt reclining office chair according to claim 13, wherein said slot extends substantially horizontally such that said seat front pivot axis remains at a substantially constant elevation when said backrest is in said normal non-reclined position and said reclined position.

* * * * *